United States Patent [19]

Wagner et al.

[11] 4,223,546

[45] Sep. 23, 1980

[54] EXTRUSION PRESS STEM WITH AT LEAST ONE CHANNEL RUNNING APPROXIMATELY AXIALLY THROUGH IT

[75] Inventors: Alfred Wagner, Steisslingen; Adolf Ames, Hilzingen, both of Fed. Rep. of Germany

[73] Assignee: Swiss Aluminium Ltd., Chippis, Switzerland

[21] Appl. No.: 925,098

[22] Filed: Jul. 17, 1978

Related U.S. Application Data

[63] Continuation of Ser. No. 676,744, Apr. 14, 1976, abandoned.

[30] Foreign Application Priority Data

May 2, 1975 [DE] Fed. Rep. of Germany ..... 2519766

[51] Int. Cl.[3] ..... B21C 25/00; B21C 35/06; B21C 25/10

[52] U.S. Cl. ..... 72/253 A; 72/261; 72/273; 72/DIG. 15; 76/101 R

[58] Field of Search ..... 72/253, DIG. 15, 264–267, 72/273, 347, 348, 349, 467, 476, 478, 479, 480, 481; 76/101 R, 107 R; 285/333, 334; 403/339, 340

[56] References Cited

U.S. PATENT DOCUMENTS

| | | | |
|---|---|---|---|
| 560,515 | 5/1896 | Mason | 72/DIG. 15 |
| 916,703 | 3/1909 | Hastings | 173/104 X |
| 1,714,818 | 5/1929 | Reed | 403/343 X |
| 1,950,938 | 3/1934 | Dunn et al. | 72/478 |
| 2,532,632 | 12/1950 | MacArthur | 285/333 X |
| 3,095,973 | 7/1963 | De Buigne | 72/264 |
| 3,444,719 | 5/1969 | Roehrs | 72/476 X |
| 3,577,753 | 5/1971 | Shah | 72/349 X |
| 3,630,064 | 12/1971 | Mahn | 72/273 |
| 3,735,623 | 5/1973 | Mann | 72/272 X |
| 3,810,379 | 5/1974 | Schlogelhofer | 72/273 |
| 3,827,271 | 8/1974 | Kishino | 72/253 |

FOREIGN PATENT DOCUMENTS

| | | | |
|---|---|---|---|
| 763673 | 11/1952 | Fed. Rep. of Germany | 72/265 |
| 1110513 | 2/1956 | France | 72/273 |
| 9026 | of 1809 | United Kingdom | 72/272 |
| 9703 | of 1843 | United Kingdom | 72/266 |
| 17829 | of 1900 | United Kingdom | 72/272 |
| 435402 | 9/1935 | United Kingdom | 72/266 |

*Primary Examiner*—Lowell A. Larson
*Attorney, Agent, or Firm*—Bachman and LaPointe

[57] ABSTRACT

An extrusion press stem exhibits at least one channel which runs approximately parallel to the central axis and connects up with a shape giving die. Such a stem as used in the indirect extrusion of materials, in particular light metal billets, is made up of component parts which fit concentrically together and is held securely together by the joints at the end of each component.

7 Claims, 5 Drawing Figures

5
Q
III
III
6s
4a

5
V
V
6
4b 5
6s
51
57
50
i
K
54
56
n
55
58

6
5
61
66
60
61
59
58
65
64
49

EXTRUSION PRESS STEM WITH AT LEAST ONE CHANNEL RUNNING APPROXIMATELY AXIALLY THROUGH IT

This is a continuation of application Ser. No. 676,744, filed Apr. 14, 1976, now abandoned.

BACKGROUND OF THE INVENTION

The present invention resides in an extrusion press stem which is characterized by at least one channel running approximately axially through it from a shape giving die. The stem is used in the indirect extrusion of materials, in particular billets of light metal.

When an extrusion billet, heated to the extrusion temperature, is hot formed into sections or rods, the billet which is surrounded by a container, is usually pushed through a stationary die by the stem of a hydraulic press.

In extrusion by the so called indirect extrusion process, the shaping die is pushed inside the stationary container after which a new billet is introduced and extruded.

The die is positioned at one end of the stem, which is highly stressed both thermally and mechanically and which has to be hollow since the extruded material passes out of the press through the stem. In supporting the die during extrusion the whole of the extrusion force, which usually involves torsional and bending stresses as well as purely compressive forces, acts on the moving stem.

A known extrusion stem of the kind described at the beginning is made up of a number of individual disc shaped parts which serve as members for supporting the shaping die. These discs are held together by a circumferential guiding sleeve which has to take up all the bending and torsional forces which develop. If the discs in the sleeve twist out of place, this leads to considerable interruption in production.

It is the principal object of the present invention to develop an extrusion stem with at least one channel running approximately axially through it, and which is able to withstand the compressive, bending and torsional stresses which develop during extrusion and which is also easily constructed and easily adapted to suit various conditions.

SUMMARY OF THE INVENTION

The foregoing objects are achieved by way of the present invention in which an extrusion stem exhibits component parts which fit coaxially together and are held tightly but releasably so by the features for joining parts with which they are provided. These component parts permit the stem they make up to have maximum adaptability to suit the prevailing conditions, without any danger of twisting or shifting during production. Furthermore the individual components can be produced and changed without great expenditure.

It has been found particularly favorable to provide the components with ring shaped collars on their front ends, into which a shoulder-like end of the neighboring component can be inserted with a push fit. In accordance with another feature of the present invention, threaded parts which fit together can be employed instead of push-fit ends. Threaded joints favor the desirable simplification in handling and, in addition ensures an adequate compensation for the forces operating.

It also lies within the scope of the present invention to provide the head of the stem and the device for holding the die which is attached, with the same means of connection so that they can be connected to the neighboring component of the stem.

The design of the stem in accordance with the present invention makes it possible for the first time in reasonable economic terms to provide several holes in the form of channels. These channels are, for reasons of temperature uniformity, preferably provided approximately in the centres of gravity of symmetrical areas in the cross section of the stem so that the stem is not weakened in the region of its central axis.

In accordance with another feature of the present invention the stem carries a radial collar by means of which the interior of the container can be cleaned by scraping, even during the time of operation of the press.

The outer surface of the component parts of the stem fit together, by way of preference, in good alignment when in the assembled operating condition. A sleeve with protective outer surface can be pushed over these stem components. This sleeve is simply for surface protection and not for connecting the component parts of the stem which is surrounds.

DETAILED DESCRIPTION

Figure 1:
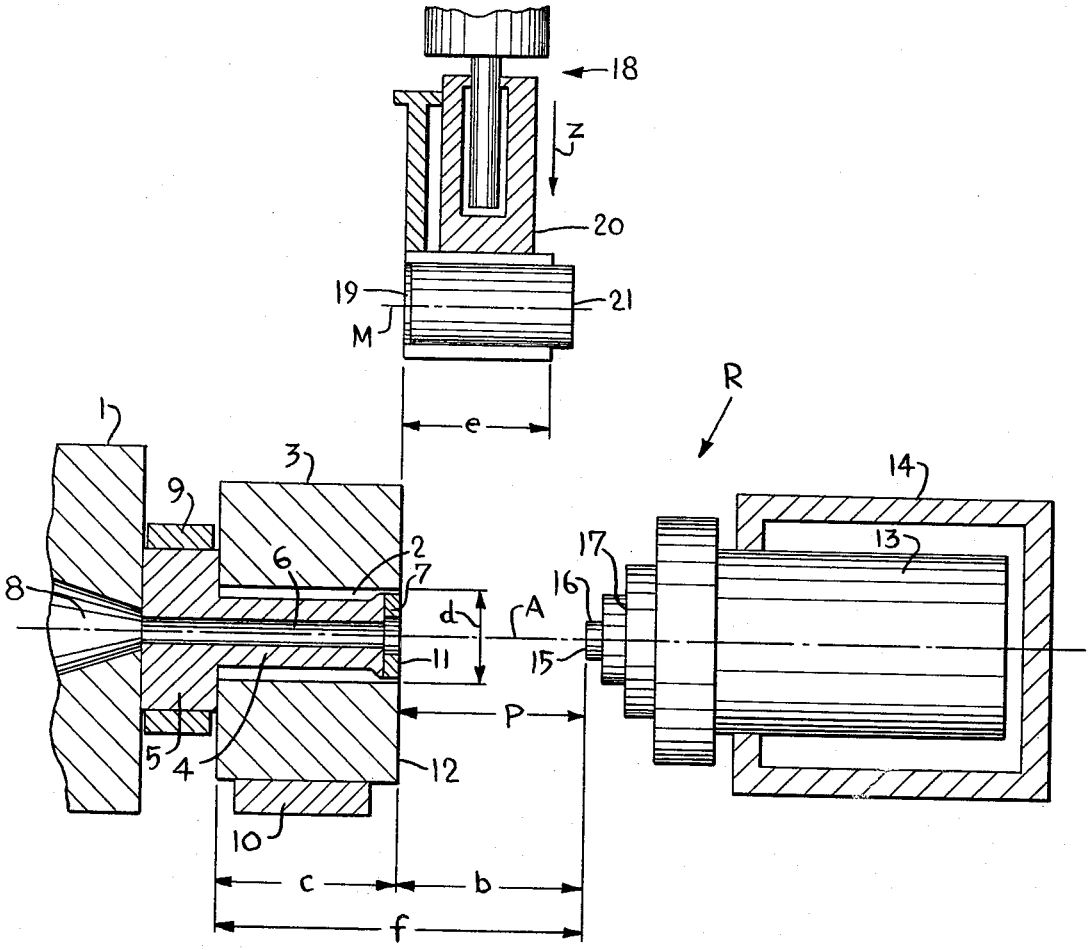
FIG. 1 is a plan view of an extrusion press at rest, showing the hollow extrusion stem and the side-feeding billet loader.

A container 3 for the so called indirect extrusion process is situated separate from and in front of the platen 1 of an extrusion press R for extruding aluminum; the container 3 can, thanks to the hole 2 running concentric to the main axis A of the extrusion press R, be led over a stationary stem 4 which is connected directly to the platen 1 at its head 5.

The stem 4*a* or 4*b* includes, as shown in FIGS. 1–5, a channel 6*s* or 6 which runs from a shaping die 7, not shown in detail in the drawing, to the opening 8 in the platen 1. The container 3 which can be moved in the direction of the principle axis A, is pushed by a device 10 over the stem which is held by a die slide 9.

Opposite the die face 11 and the front 12 of the container facing away from the platen 1 is the main ram 13 in its stands 14. During the time of rest, or loading stage, shown in FIG. 1, the width "b" of the gap P between the die face 11 and the adjacent working face 15 of the main ram 13 corresponds approximately to the length "c" of the container 3 so that the dimension "f" of the maximum distance traversed by the container does not exceed by much twice the length "c" of the container 3; this distance amounts to about four times the inner diameter "d" of the container bore 2.

The face of a plug 16 which projects out from the centre of the sealing plate 17 of the main ram 13 serves as the working pressure face 15. The cross sectional shape of this plug 16 is chosen to suit the prevailing requirements; the plug 16 can, but not shown here, be removed from the main press 13 and be replaced by another plug of different cross section.

A billet loader 18 is situated at the side and at a distance from the axis A of the extrusion press R. A cylindrical extrusion billet 21 rests in the concave surface 19 of the billet feeder 20 of the loader 18 and can be moved by the feeder 20 perpendicular to the main axis A.

In order to load the press R with the billet 21, the billet feeder 20 of the loader 18 is moved in the direction Z until the axis M of the billet is in line with the axis A of the press R. When the billet 21 has been centred in front of the container bore 2, the working face 15 of the main ram 13 is moved forward until it presses the billet 21 against the die 7 so that the billet 21 is held between the main ram 13 and the die 7. After the billet feeder 20 has been drawn out of the gap P, the container 3 moves over the billet 21 without touching it, until the front 12 of the container 3 is in contact with the sealing plate 17 of the main ram 13.

The extrusion press R is thus loaded for extrusion, in the course of which the main ram 13 pushes the billet 21 which is surrounded by the container 3, through the die 7 while the container 3 moves simultaneously towards the platen 1 at a speed in keeping with the rate of extrusion.

Figures 2, 3, 4, 5:
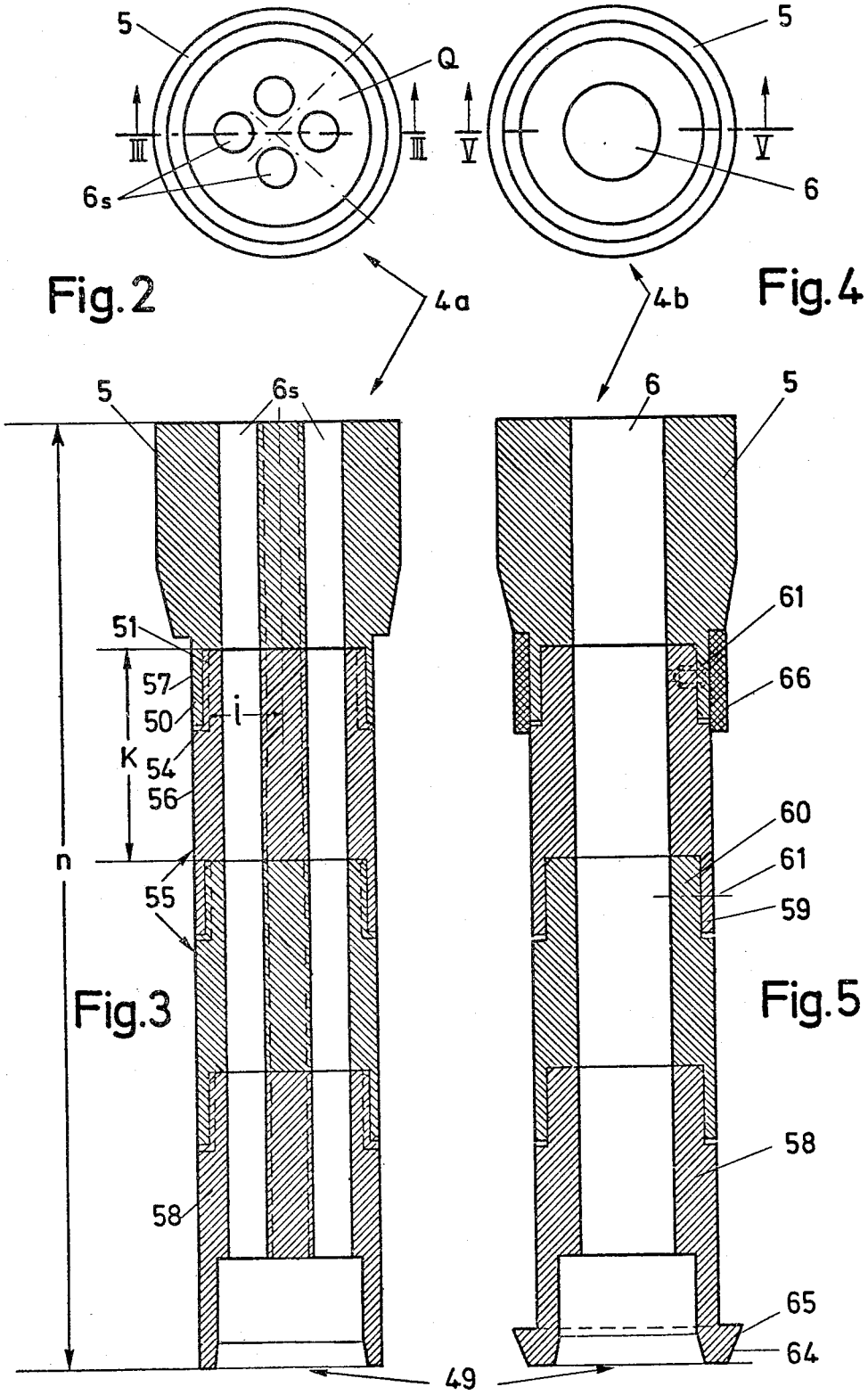
FIG. 2 is a plan view of the front of the extrusion stem in accordance with a first embodiment of the invention.
FIG. 3 is a cross sectional view of the extrusion stem along the line III—III in FIG. 2.
FIG. 4 is a plan view of a stem front in accordance with a second embodiment.
FIG. 5 is a cross section through the stem shown in FIG. 4 along the line V—V.

The head 5 of the stem 4*a* is shown in FIGS. 3 and 4 has channels 6*s* parallel to the stem axis which terminate in a ring shaped collar 50 which is provided with a thread in the inside. In the threaded opening 51 of radius "i" there is inserted a threaded part 54 of a stem component 55 the shoulders of which make contact with the head 5 of the stem 4, the outer cylindrical surface 56 being in line with the outer face 57 of the ring shaped collar 50.

The stem component 55 of length k exhibits at the other end a ring-shaped collar 50 which accepts a threaded end 54 of another stem component 55.

The stem 4*a*, the total length "n" of which is fixed by the number of stem components 55, terminates at the opposite end of the stem 4*a* from the head 5 i.e., at the front end 49, in the form of a component 58 for holding the die 7 which is not shown in detail in FIGS. 2 to 5.

Since the stem 4*a* exhibits a channel 6*s* approximately at the centre of gravity of each of four symmetrically placed sub-divisions Q (e.g. dot-dash lined section in FIG. 2), a channel 6 of radius u passes through the stem 4*b* of FIG. 5.

The individual stem components 55 of the stem 4*b* shown in FIGS. 4 and 5 are joined by means of push-fit ends 59, 60 and are also held securely in a known manner with some safe means e.g. by a central bolt 61.

On the side 49 of the stem 4*b* next to the die a ring-shaped collar 64 is provided the edge 65 of which may be knife shaped and serves to clean the bore 2 of the container 3 as it passed over it. A protective sleeve 66 which surrounds the outer faces of the stem components 56, 57 is shown in part in FIG. 5.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What we claim is:

1. An extrusion press stem having an axis, said stem having a die mounted thereon at one end thereof for use in the indirect extrusion of a light metal billet, and adapted to fit tightly into a passage of a container, comprising, in combination:

a plurality of stem components being disposed in adjoining series arrangement along said axis, the end portion of each of said stem components near said die has an increased inside diameter and the other end has a reduced outside diameter whereby said other end of said stem components is telescopically received in said end portion of said adjoining component such as said stem components are interconnected tightly but releasably by their adjacent concentric peripheral end portions whereby the overlapping peripheral end portions of said stem components prohibit said stem components from separating when withdrawing said extrusion press stem from said container;

said stem defining at least one channel extending the entire length thereof substantially parallel to said axis, and means for cleaning the container passage during operation of said extrusion press by scraping surplus metal off the container, the cleaning means including a portion projecting outwardly and substantially radially from the end of the stem component nearest the die.

2. An extrusion press stem having an axis, said stem having a die mounted thereon at one end thereof for use in the indirect extrusion of a light metal billet, comprising, in combination:

a plurality of stem components being disposed in adjoining series arrangement along said axis, the end portion of each of said stem components near said die has an increased inside diameter and the other end has a reduced outside diameter whereby said other end of said stem components is telescopically received in said end portion of said adjoining component such that said stem components are interconnected tightly but releasably by their adjacent concentric peripheral end portions whereby the overlapping peripheral end portions of said stem components prohibit said stem components from separating when withdrawing said extrusion press stem from said container;

said stem defining at least one channel extending the entire length thereof substantially parallel to said axis.

3. The stem as claimed in claim 2 wherein, said other end is press fit into said end portion of the adjoining stem component to form said stem and further comprising connecting means for holding in place said adjoining stem components.

4. The stem as claimed in claim 2 wherein said stem components are threaded on said increased inside diameter and said reduced outside diameter, whereby said stem components threadably engage each other to form said stem.

5. The stem as claimed in claim 2 wherein the end of said stem component nearest said die includes a portion projecting outwardly and substantially radially from said axis to define a scraping edge.

6. The stem as claimed in claim 2 wherein the other surface of said stem components are substantially in line with each other to define a substantially flush surface.

7. The stem as claimed in claim 2 wherein there are a plurality of channels having a cross section defining a plurality of symmetrical areas, each channel defining an aperture at approximately the center of gravity of a corresponding symmetrical area.

* * * * *

UNITED STATES PATENT AND TRADEMARK OFFICE

CERTIFICATE OF CORRECTION

PATENT NO. : 4,223,546

DATED : September 23, 1980

INVENTOR(S) : Alfred Wagner and Adolf Ames

It is certified that error appears in the above-identified patent and that said Letters Patent are hereby corrected as shown below:

Column 1, line 54, delete "parts".

Column 2, line 24, change "is" to --it--.

Column 3, line 27, after "shown" insert --enlarged--.

Column 3, line 55, change "passed" to --passes--.

Column 4, claim 1, line 11, change "as" to --that--.

Column 4, claim 6, line 60, change "other" to --outer--.

Signed and Sealed this

*Twenty-third* Day of *December 1980*

[SEAL]

*Attest:*

SIDNEY A. DIAMOND

*Attesting Officer*

*Commissioner of Patents and Trademarks*